United States Patent [19]

Moebus et al.

[11] 4,038,829

[45] Aug. 2, 1977

[54] METHOD OF AND APPARATUS FOR LINING A TUNNEL

[75] Inventors: Dieter Moebus, Bochum; Werner Mennekes, Altlunen-Wethmar; Rudi Podjadtke, Bochum, all of Germany

[73] Assignee: Bochumer Eisenhutte Heintzmann & Company, Bochum, Germany

[21] Appl. No.: 725,194

[22] Filed: Sept. 21, 1976

[30] Foreign Application Priority Data

Sept. 25, 1975 Germany ..... 2542778

[51] Int. Cl.[2] ..... E01G 5/00

[52] U.S. Cl. ..... 61/84; 61/42; 61/45 R

[58] Field of Search ..... 61/84, 85, 42, 45 R, 61/63; 299/31-33; 425/59, 63

[56] References Cited

U.S. PATENT DOCUMENTS

| | | | |
|---|---|---|---|
| 2,486,801 | 11/1949 | Sarosdy | 425/63 |
| 3,206,824 | 9/1965 | Cerutti | 425/59 |
| 3,678,694 | 7/1972 | Haspert | 61/84 |

FOREIGN PATENT DOCUMENTS

| | | | |
|---|---|---|---|
| 570,809 | 9/1958 | Belgium | 61/84 |
| 1,213,880 | 4/1966 | Germany | 61/84 |

*Primary Examiner*—Dennis L. Taylor
*Attorney, Agent, or Firm*—Michael J. Striker

[57] ABSTRACT

A portal-shaped installation car picks up at an assembly location remote from the face of the tunnel an upper part of a tunnel-lining arch on a pallet. It then rides along rails secured to the side of the tunnel to the face location and presses this upper part against the tunnel roof, whereupon the lower tunnel-lining arch parts are secured in place. Thereafter the car returns with the empty pallet to the rear end of the tunnel at the assembly location and deposits this empty pallet to pick up a full pallet carrying another upper arch part. The sequence is then repeated. As each upper arch part is being secured at the face of the tunnel another upper arch part is assembled on the previously deposited empty pallet with the help of a portal crane that also rides on the rails along the sides of the tunnel.

28 Claims, 6 Drawing Figures

METHOD OF AND APPARATUS FOR LINING A TUNNEL

BACKGROUND OF THE INVENTION

The present invention relates to a tunneling method and apparatus. More particularly, this invention concerns a method of and arrangement for lining a tunnel with a succession of arches each having an arcuate upper part for engaging the tunnel roof and lower parts juxtaposable with the tunnel sides and engageable with the tunnel floor for supporting the respective upper part.

It is frequently desired to line a tunnel, by which here is meant a horizontal or nearly horizontal underground passage also often referred to as an added, level or drift, with a succession of lining arches. Each of these arches is normally formed of steel or iron and is bolted to the adjacent arches so as to form a rigid lining within the tunnel. Such a lining prevents the tunnel from caving in and is typically used in tunnels which will be used for substantial traffic over a long period of time.

In order to make the tunnel lining operation go as quickly as possible it is standard practice to at least partially preassemble the lining arches. Thus the various parts that constitute the upper part of the lining are normally preassembled in the mine at a location distant from the face thereof, the face here referring generally to the tunnel area adjacent the end at which it is being driven.

In the most common arrangement a fork-like assembly head is displaceable relative to an installation wagon that can be displaced between the assembly location in the tunnel and the face where the lining arches are installed immediately behind the tunneling equipment. This installation wagon is displaceable along two rails which are hung from the lined part of the mine. The assembly and installation head is thus displaced ack to the assembly location and lowered so that the upper arch portion can be preassembled on it. After this preassembling the head is again lifted and the preassembled roof part is moved along the mine up to the face. Then it is positioned against the mine roof and the side portions or lower portions of the respective arch are secured to the upper portion so as to complete this arch.

Although such a procedure is in principle more efficient that an operation wherein the entire arch is assembled piece-by-piece at the face, the arrangement has the considerable disadvantage that it ties up the installation car doing preassembly of the upper arch part. Nonetheless since each upper arch part normally comprises several different parts, usually a few arcuate channels along with some sheet-metal sheathing it is not possible to preassemble the upper arch part simply on the mine floor. The installation head fits closely with the upper arch part so that assembly of this part on it is a relatively simple matter.

Other disadvantages of this known system is that the installation car often takes up considerable room in the tunnel so that it cannot be moved back and forth for installing lining arches while tunneling is going on. Thus when a lining arch is to be installed all of the other operations in the tunnel must be brought to a halt, idling expensive equipment and wasting valuable man-hours. This is particularly the case when the tunnel is being driven by drilling and blasting. Furthermore, the use of a hanging installation car is highly disadvantageous in that the car often tends to swing somewhat from side to side so that it is necessary to advance the assembled upper arch portion very slowly from the assembly location to the mine face in order to prevent it from striking the sides of the tunnel or equipment therein and damaging either itself or whatever it strikes. Not only does the hanging installation car have to move very slowly, therefore slowing down operations further, but is is very difficult accurately to position the upper arch portion from such a hanging car. For this reason it is a relatively lengthy operation to accurately position the upper arch portion before the lower portions can be secured thereto. It is also noted in this respect that the upper arch portion cannot simply be pressed against the mine roof before the lower arch portions are in place so as to prevent cave-ins in back of the tunneling machinery.

SUMMARY OF THE INVENTION

It is therefore an object of the present invention to provide an improved method of and apparatus for tunneling.

Another object is the provision of an improved method of and arrangement for lining a tunnel with support arches as described above.

Yet another object is the provision of an improved tunnel-lining method which can be carried out at the same time as the tunnel is advanced, and which can line the tunnel with considerable speed.

Yet another object is to provide an improved tunnel-lining arrangement which can be used for supporting the mine roof in back of the tunneling equipment, pit-prop fashion, during the tunneling operation and before the lower arch parts are in place.

These objects are obtained according to the present invention in a tunneling method wherein the upper arch portions are assembled on assembly pallets at an assembly location remote from the tunnel face. These pallets two of which are provided, are transported back and forth one-at-a-time between the tunnel face and the assembly location by the installation head of an installation car. An assembly table is provided at the assembly location so that the installation car can pick up a pallet with an assembled upper arch portion, carry it to the face and hold it in place while the lower arch portions are secured thereto while simultaneously another upper arch portion is assembled on the other pallet. Once the lower arch parts are secured in place the pallet carrying the upper arch part is then disconnected from this upper part and displaced back by the installation car to the assembly location so that the installation car can pick up the other pallet and move back to the face while the pallet just deposited at the assembly location is fitted with another upper arch part.

This procedure is highly efficient in that the installation car is always either holding an upper arch part in place against the mine roof while the lower arch parts are secured to it, or moving back and forth between the assembly location and the face. There is virtually no time wasted at the assembly location as all the installation need do at this location is drop off an empty pallet and pick up a full pallet.

According to another feature of this invention the installation car is generally portal-shaped and rides on a pair of rails extending longitudinally of the tunnel adn each secured to a respective side wall of the tunnel. This portal-shaped car corresponds closely to the inner shape of the tunnel so that it takes up little room in the tunnel and can readily pass over mining machinery and similar obstructions in the tunnel. Furthermore, such a mounting gives the installation car an extremely sound purchase so that it can lift and position very heavy arch sections, a possibility which was ruled out with the relatively light hanging cars of the prior art.

In accordance with yet another feature of this invention the upper arch parts are assembled at the assembly location by means of a similar portal-shaped crane which also rides on the above-mentioned rails and is provided with a hoist for moving and positioning the upper arch pallets held on the assembly table. Thus both of these pieces of machinery, the installation car and the assembly crane, can move over various obstructions in the tunnel and do their jobs without interfering with other operations in the tunnel.

According to yet another feature of this invention the assemvly table at the assembly location allows the pallets to be moved back and forth between a near end of the table relatively close to the face and a far end relatively far from the face. The empty pallet that is being returned from the face by the installation car is deposited on this table at the middle of it or at the far face of it, then the installation head picks up an other pallet with an assembled upper part on it. The assembly may take place at the far end of the assembly table so that after an upper arch part is assembled it is pushed along the table to the near end of it and the empty pallet being returned by the installation car is deposited behind this full pallet, then is displaced backwardly to the far end of the table if desired or if necessary to move the installation head between the two pallets.

In accordance with further features of this invention as the installation car moves from the assembly location toward the face it also transports the lower parts of the arch whose upper part is being carried on the pallet to the face. During all of these operations the tunneling may continue, even by blasting and drilling as the installation car takes up a limited amount of space so that the relatively bulky tunneling equipment can easily fit under it.

According to a further feature of this invention the assembly table is raisable and lowerable in order to facilitate assembly of the upper arch parts and permit other equipment to pass over this table. The above-mentioned crane is used to displace this assembly table toward the face as the lining is advanced. To this end the assembly table is constituted as a plurality of separate but joinable sections having trough-shaped upper portions and extensible legs to allow for proper positioning of these sections relative to each other.

The rails according to this invention are also formed as a plurality of sections each having a length corresponding to the length in the longitudinal direction of the tunnel of a lining arch. Thus when a lining arch is completed a section of rail is secured to it so that the installation car can be moved that much forward in the tunnel. These rails have toothed upper surfaces and are secured via brackets to the tunnel lining. Independently sprung cog wheels are provided in two pairs at each side of the travelling assembly car so as positively to move it back and forth in the tunnel. To this end the travelling installation car has hydraulic motors which operate these wheels thus making this car self-powered.

The installation car is provided according to this invention at its rear end, that is its end opposite its front end where the installation head is mounted, with a roof-engaging brace that is hydraulically pressably against the mine roof in order to stabilize the installation car. This feature, in combination with a rigid portal-shaped frame constituted of U-shaped and double T-shaped steel beams makes the assembly very rigid so that it is possible for it to support very heavy loads and, indeed, even support the mine roof before the lower arch portions of an arch being installed are in place.

The various machines according to this invention are all of individually self-powered. Thus the hydraulically operated installation car can be controlled independently of the other devices. The assembly table and assembly crane are preferably pneumatically operated, as these machines do not need to dispose of the considerable force which the installation car may at times have to exert.

The installation head according to this invention is carried on a paralleleogrammatic linkage constituted by a pair of generally parallel arms pivoted by their front ends on the installation head and at their rear ends on a bracket approximately midway between the top and the bottom of the front end of the installation car. A hydraulic cylinder is connected to at least one of these arms so as to lift the head when the cylinder is shortened. In addition to a mechanical latching arrangement may be provided in order to hold up the head once it has been lifted so that maintenance of hydraulic pressure is not necessary to prevent dropping of the head and the arch supported thereby. Such a mechanical latching arrangement can be a rack mounted on the cylinder or piston element of the ram and a pawl or latching dog engaging this rack and mounted on the other part of the arm. Actually two such parallel arms are provided on each side of the car secured to the head and lying within longitudinal extensions of the portal-shaped frame of the car so that in raised position these arms do not project downwardly and offer no obstruction to anything underneath the installation car. Furthermore, the head can be moved limitedly longitudinally in the direction of the tunnel and transversely thereto and can also be tipped about a horizontal axis in order accurately to position the upper arch portion in place. Such arrangement allows the upper arch part to be accurately positioned and therefore makes it a relatively simple job to connect to the adjacent arch and to the lower arch parts. A portable control box is provided connected to the installation car for controlling the various movements of this car and the installation head thereof.

The pallets according to this invention are formed as jigs with holders for assembling the upper arch parts formed of arcuate channels, sheathing, and bolts. There lower sides are provided with a pair of longitudinally extending rails adapted to be received in roller conveyors forming the upper surface of the assembly table. This upper surface can be raised and lowered in order to allow various pieces of equipment to pass this table without hindrance. Furthermore each of these pallets is provided with quick-release connections on its lower porton which allow it readily to be connected to and disconnected from the installation head.

The upper parts are assembled according to this invention by a portal-shaped crane which is pneumatically operated. This crane can lift the various parts of the arches into place on the assembly table so as to allow workers very easily to assembly these upper parts. Furthermore, as mentioned above, this crane serves to displace the sections of the assembly table toward the face as the tunneling progresses. This crane is provided with cogwheels like the installation car so that it can be positively displaced along the rails in the tunnel. Furthermore such cogwheel construction makes it possible for this system to operate in the tunnel inclined by as much as 7 degrees.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF THE PREFERRED EMBODIMENT

Figure 1:
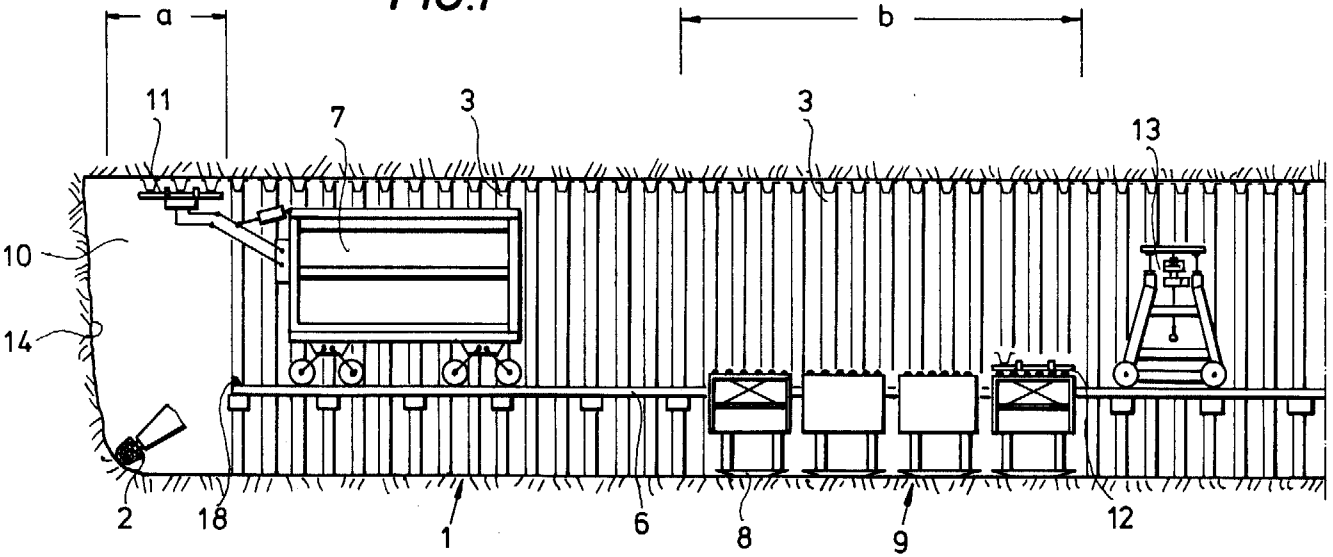
FIG. 1 is a longitudinal section through a tunnel being lined in accordance with the present invention.
Figure 3:
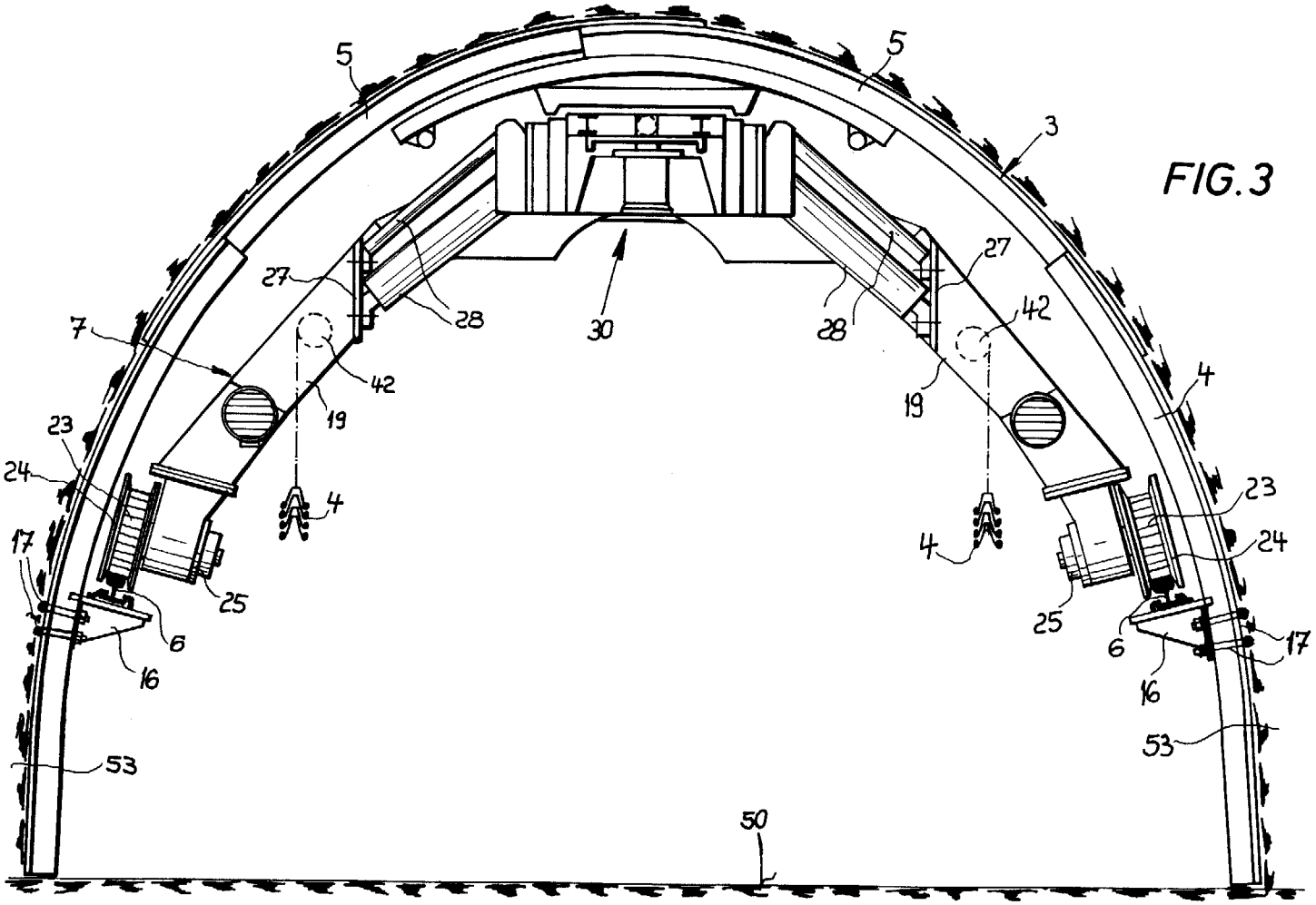
FIG. 3 is a section taken along line III—III of FIG. 2.

FIG. 1 shows a generally horizontal underground passageway hereinafter designated as a tunnel 1 which is being driven by means of a tunneling tool 2 of known type. The tunnel is provided with a succession of lining arches 3 formed as shown in FIG. 3 of side or floor parts 4 and roof parts 5. The lining arches 3 are in place by means of an installation car indicated generally at 7 that rides on rails 6 extending horizontally and secured to the side parts 4. An assembly table 9 mounted on skids 8 is provided at and defines an assembly location separate from the front end or face end 10 of the mine tunnel 1. The roof parts 5 are emplaced and transported on pallets 11 and 12 on which they are assembled with the help of a crane 13 prior to their transportation up to the area 10 at the face 13 of the mine.

The tunnel section shown has an overall length of approximately 30 meters and the rails 6 are subdivided into sections having a length *a* equal to the length of approximately 3 of the channels forming the upper portions 5, that is a length of 2.25 meters with the elements 5 having a length 0.75 meters. The upper parts 5 are emplaced three deep so that an exposed areas having the minimum length *a* equal to 2.25 meters is left at the front end 10 of the mine at all times.

These rail sections 6 are connected together via couplings 15 and secured via brackets 16 and J-bolts 17 to the lower parts 4 of the lining 3. In addition chunks 18 are provided at the extreme downstream ends of these rails 6 to prevent the car 7 from falling off the downstream end into the region 10. The bolts 17 engage through elongated slots in the bracket 16 to allow vertical adjustment up and down by 100 mm so that irregularities in the lining 3 can be compensated for.

Figure 2:
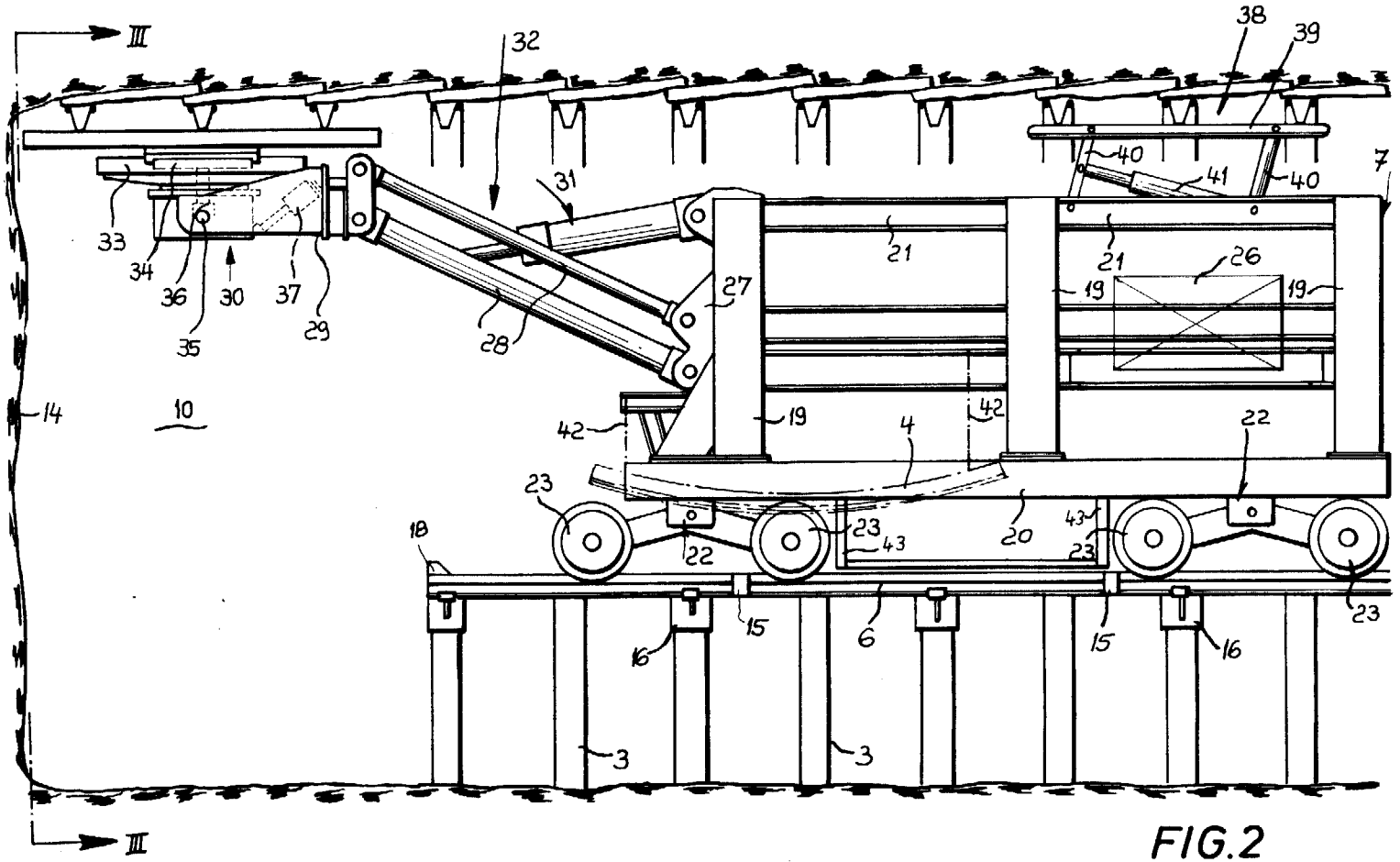
FIG. 2 is a large-scale view of a detail of FIG. 1.

The installing car 7 is formed entirely of U-profile and Y-flange double-T-profile steel members and is of general portal shape as best shown in FIGS. 2 and 3. It has three arch-like steel beams 19 which have shapes closely conforming to the inside of the support arches 3 serving as tunnel lining and connected together by means of horizontally extending beams 20 and 21.

The car 7 has on each side two bogeys 22 having independently sprung cogwheels 23 engaging with teeth formed on the top of the rails 6 and provided with flanges 24. These wheels 23 are individually sprung so as to be vertically displaceable through 80 mm. In addition respective hydraulic motors 25 drive these wheels 23. An electric motor shielding against sparking to prevent explosion in the mine and an adjustable pump 26 power these motors 25 so that the car 7 need merely be connected to a heavy duty power line.

At its front end the housing is provided with two brackets 27 on each of which is pivoted a pair of parallel arms 28 in turn pivoted at their front ends on the support plate 29 of an installing head 30. A hydraulic cylinder 31 provided with mechanical latching means 32 is connected between the upper part of the car 7 and the arm 28 so that when lifted these arms 28, which converge in the direction of displacement of the car 7, lie in the extension of the elements 19 and, as shown in FIG. 3, can therefore move over any objects underneath the portal-shaped frame of this car 7. The head 30 is provided with a pallet support plate 33 that can be moved longitudinally of the tunnel, transversely of the tunnel and tipped about a horizontal axis transverse to the tunnel by means of slides and cylinders 34 - 37.

At its read end the upper member 21 of the car 7 is provided with a stabilizer 38 in the form of a horizontally extending rail 39 connected via pair of parallel arms 40 to the element 21. An expansible hydraulic cylinder 41 can swing the rail 39 up into right engagement with the roof of the tunnel so as to stabilize the car 7 and allow the head 10 to be pressed with considerable force against the roof also.

As also shown in FIGS. 2 and 3 the car 7 has hoists 42 and holders 43 for picking up and carrying the lower arch parts 4 and sections of rails 6.

Figure 4:
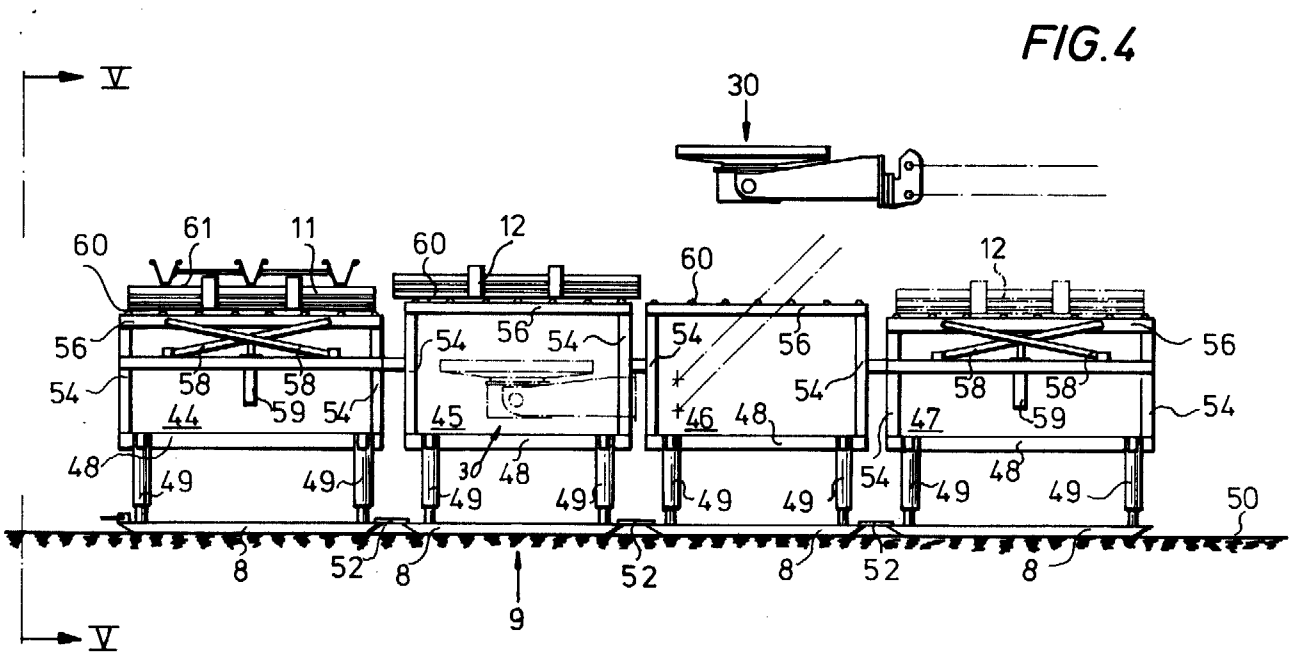
FIG. 4 is a large-scale side view of another detail of FIG. 1.
Figure 5:
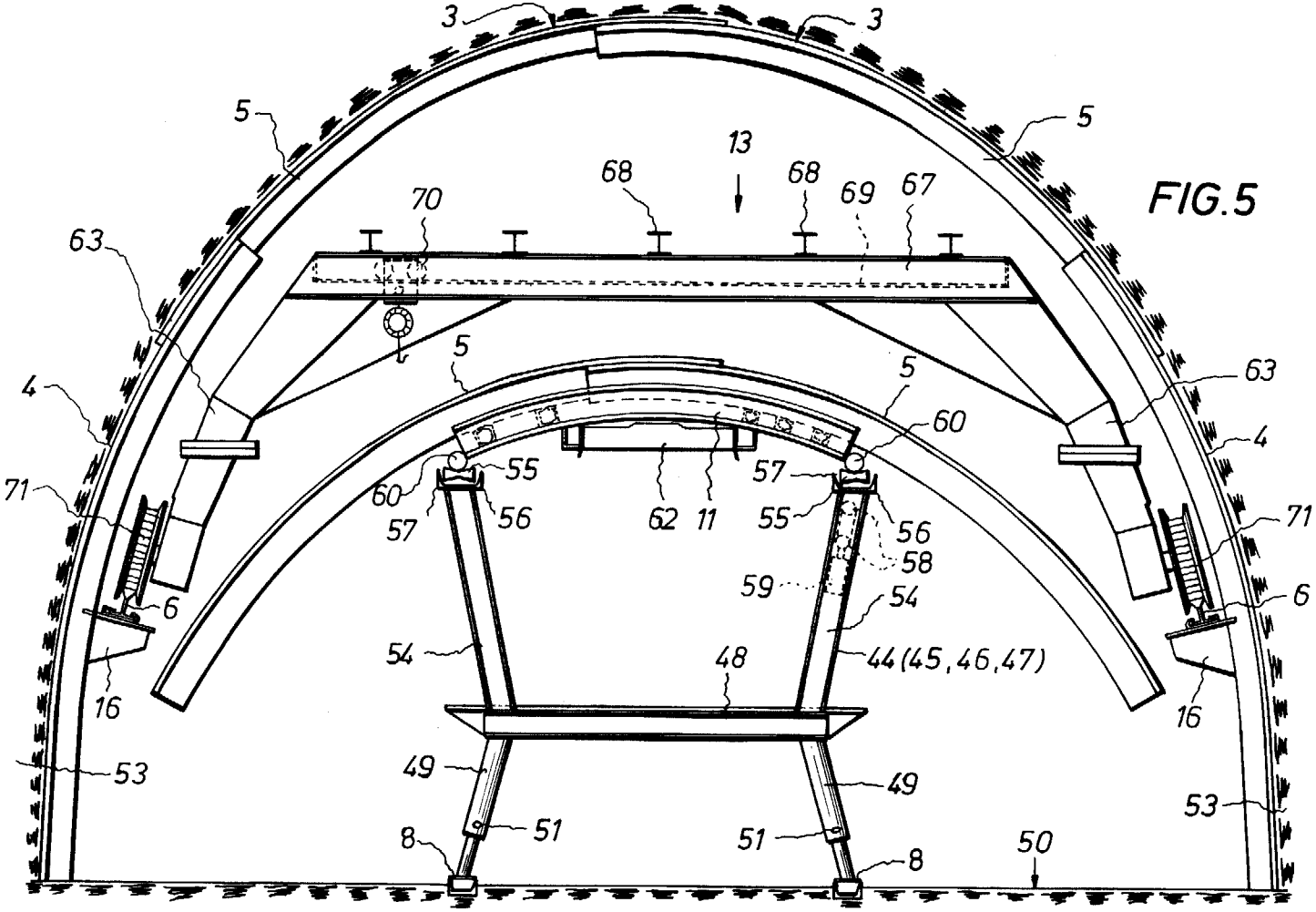
FIG. 5 is a section taken along line V—V of FIG. 4.

As shown in FIGS. 4 and 5 the assembly table 4 which is located some 20 meters from the face 14 is subdivided into four sections 44 - 47. Each such section has a displaceable platform 48 which is carried on extensible legs 49 engaging the floor 50 and having pins 51 that can lock them in their various portions. The skids 8 are carried on the lower ends of these legs 49 and can be connected together between the sections 44 - 47 by means of releasable clips 52. The sections 44 - 47 each have an overall length substantially equal to a so that the rearmost section 47 can be picked up by the crane 13 and placed in front of the frontmost section 44 to step the table 9 along the tunnel 1.

Carried on each of the platforms 48 are four upwardly outwardly extending and telescoping arms 54 which are inclined slightly relative to the side walls 53 of the tunnel 1. The arms 54 on each side of the platforms 98 carry upwardly open C-sectioned beams 56 between whose flanges 57 are rotatable rollers 55 of hyperboloidal shape. A scissor linkage 58 operated by means of a pneumatic cylinder 59 on each side of each platform 48 allows the respective beam 56 to be raised and lowered through a distance of approximately 150 mm.

FIGS. 4 and 5 also show how each of the pallets 11 and 12 has a pair of longitudinally extending circular-section side member 60 which are so positioned as to lie on the rollers 55 so that these pallets 11 and 12 can readily be slid along the roller conveyors formed by these rollers 55. In addition the pallets 11 and 12 are provided with stops or holders 61 so that these pallets can act as jigs for the preassembly of the roof sections 5 together along with the sheathing that connects them.

Each pallet 11 and 12 also is provided on its underside with a quick-release couplng 62 that mates readily with the plate 33 of the head 30 and allows, therefore the pallets 11 and 12 to be securely and rapidly mounted and disconnected from this head 30.

Figure 6:
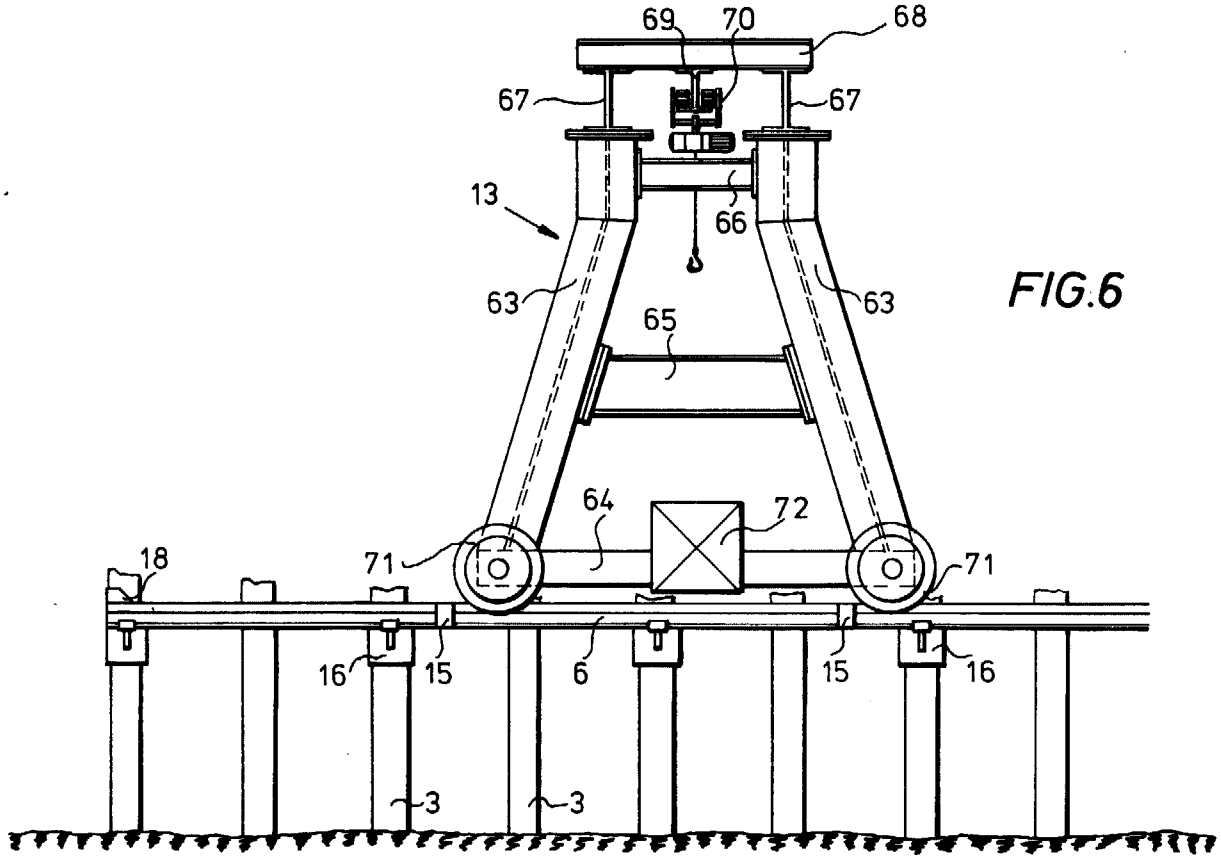
FIG. 6 is a large-scale view of yet another detail of FIG. 1.

The crane 30 as best shown in FIGS. 5 and 6 is formed also entirely of U-profile and a double-T-profile steel beams. The V-shaped side members 63 have a shape corresponding generally to that of the arches 3 and of the elements 19 of the car 7 so that this crane 13 can also readily pass over structure in the tunnel 1. Horizontally extending beams 64, 65, and 66 connect these main members 63 and longitudinal beams 68 overlie transverse I-beams 67. Furthermore, in the middle of the crane there is provided hung between the beams 68 a transverse I-beam 69 on which is slidable a hoist trolley 70 operated by a pneumatic motor. Furthermore, the lower ends of the elements 63 are provided with wheels 71 identical to the wheels 23 and powered by a pneumatic motor 72.

The structure described above allows the pneumatic, hydraulic, and electric feed lines to run along the tunnel without hindrance. Furthermore, the conveyors for removing rock or the like broken free by the tool 2 can also readily extend back through the tunnel underneath all of this structure necessary for lining the tunnel.

The apparatus according to this invention functions as follows:

After the upper part 5 on the pallet 12 has been mounted in place and the pallet 12 freed from this upper part 5 the head 30 moves back to a position above the section 45 of the table 9 as shown in FIG. 4. Then this head 30 is lowered to rest the pallet 12 on top of the roller conveyors 56, and the car 7 is backed up so that the head can be pulled out from underneath the pallet 12, into the station 46, and raised up above the table 9. Thereupon the empty pallet 12 is slid back along all of the sections 45–47 until it comes to rest on the rear section 47.

The car 7 then moves forward to a position of the head 30 above the section 45, whereupon the head 30 is lowered below the level of the conveyor 11 carried at the station 44 and itself supporting a ready-to-go roof section 5. The car 7 is then advanced so that the head 30 comes under the loaded pallet 11. Raising of the head 30 then allows this loaded pallet to be picked up. At the same time the lower parts 4 and rail sections 6 are picked up by the hoist 42 fitted into the holders 43.

Thereafter the car 7 moves to the face region 10 of the tunnel 1 and presses its brace 38 against the roof of the tunnel 1. The head 30 is then lifted and the various mechanisms 34 - 37 are operated in order accurately to position the roof part 5. Once it is in position workers emplace and bolt together the rest of the arch 3. It is noted that the arrangement is so very strong that it can hold the sections 5 up and even prevent cave-ins before the sections 4 are in place.

At the same time another roof part is being assembled on the empty pallet 12 at the station 47. To this end the platform 48 at the station 47 is lowered all the way down and crane 13 is used to position the various channels and sheathing in place so that workers can preassemble an entire roof section. Once it is fully assembled the platform 48 at the station 47 is raised and the loaded pallet 12 is moved up to the station 44. Thereupon the entire operation can be repeated.

As the tunnel advances through increments a the table 9 is moved toward the face location 10 by means of the crane 13 which periodically picks up the rearmost section 47 and emplaced it in front of the frontmost section 44. Appropriate adjustment of the legs 49 insures that the table remains relatively flat and that the roller conveyors 56 remain properly in line.

During this lining operation it is possible for the tunneling to be continued, even by drilling and blasting. This allows the tunnel to be advanced almost continuously, with various crews operating at various stations all at the same time.

It will be understood that each of the elements described above or two or more together, may also find a useful application in other types of machine differing from the types described above.

While the invention has been illustrated and described as embodied in a tunneling arrangement, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A tunneling method comprising the steps of:
   a. assembling on one assembly pallet the upper part of a tunnel-lining arch in a tunnel at an assembly location remote from the tunnel face;
   b. thereafter transporting said one assembly pallet and the assembled upper part thereon to the tunnel face and positioning the upper part against the tunnel roof;
   c. thereafter securing lower parts of the lining arch to the upper part positioned against the roof while holding said upper part in place with said one pallet;
   d. assembling another upper part of another lining arch at said assembly location on another assembly pallet simultaneously with steps (b) and (c); and
   e. thereafter transporting said one pallet back to said assembly location and picking up said other pallet with said other upper part and repeating steps (b) and (c) with said other pallet and said other upper part and repeating steps (d) with said one pallet.

2. The method defined in claim 1, further comprising the steps of transporting the lower parts of each of said arches to said face while transporting the respective assembled upper part to said face.

3. The method defined in claim 1 wherein said assembly location has a near end relatively close to said face and a far end relatively far from said face, said pallets being deposited at said location between said ends and being picked up from said location at said near end, said method comprising the step of transporting each of said pallets after deposition between said ends to said far end, said upper parts being assembled on said pallets at said far ends.

4. The method defined in claim 3 wherein said pallets are transported, picked up, and deposited by an installation head, said method comprising the further steps of lowering said head intermediate said ends to deposit a one of said pallets, thereafter raising said head to allow the just-deposited pallet to be transported back to said far end, and thereafter lowering said head again and positioning same under a loaded pallet at said near end to pick same up.

5. The method defined in claim 1, further comprising the step of raising and lowering said pallets at said assembly location to allow machinery to pass said pallets at said location in said tunnel.

6. The method defined in claim 1, further comprising the step of supporting said pallets at said assembly location on a table and advancing said table periodically toward said face.

7. The method defined in claim 1, further comprising the step of driving said tunnel and advancing said face during most of said steps (a) through (e).

8. An arrangement for lining a tunnel with a succession of arches each having an arcuate upper part for engaging the tunnel roof and lower parts juxtaposed with the tunnel sides and engageable with the tunnel floor for supporting the respective upper part, said arrangement comprising:

an assembly table positionable in said tunnel at a location distant from the tunnel face;

two assembly pallets supportable on said table and each constituted to support a respective arch upper part;

means for assembling an arch upper part on either of said pallets on said table at said location;

a rail extending along each of said tunnel walls from said location toward said face;

an installation car displaceable along said rails and having an installation head fittable with each of said pallets;

means for raising said head to pick up a one of said pallets carrying an assembled upper part and to press same against the tunnel roof and for lowering said head to deposit a one of said pallets on said table; and means on said car for displacing said car along said rails and transporting said pallets and assembled upper parts between said location and said face.

9. The arrangement defined in claim 8 wherein said car is portal-shaped and can pass over machinery and the like in said tunnel between said walls thereof.

10. The arrangement defined in claim 9 wherein said means for vertically displacing includes at least one arm pivoted on said car and on said head and a hydraulic ram between said arm and said car.

11. The arrangement defined in claim 10 wherein said means for vertically displacing includes a pair of such arms extending generally parallel to each other and forming a parallelogrammatic linkage between said head and said car.

12. The arrangement defined in claim 9 wherein said car is provided with means for limitedly displacing said head in and transverse to the direction of motion of said car along said rails.

13. The arrangement defined in claim 12 wherein said car is provided with means for limitedly tipping said head about a horizontal axis.

14. The arrangement defined in claim 9 wherein said head is mounted on said car at its end closer to said face, said car further comprising at its opposite end a brace engageable with the mine roof and means for pressing said brace against said mine roof during positioning of an arch upper part to stabilize said car.

15. The arrangement defined in claim 9 wherein said car has a pair of sides each at a respective rail and at least two independently sprung wheels at each side engaging and spaced apart along the respective rail.

16. The arrangement defined in claim 15 wherein said means for displacing said car along said rails includes a hydraulic motor connected to each of said wheels said wheels being cogwheels and said rails meshing with said cogwheels.

17. The arrangement defined in claim 16 wherein two pairs of such wheels are provided along each side of said car and one such motor is provided for each pair of wheels.

18. The arrangement defined in claim 9 wherein said car is provided with means for carrying the lower parts of an arch, whereby said car can transport an entire arch from said assembly location to said face.

19. The arrangement defined in claim 9 wherein each of said rails includes a plurality of sections, unions for longitudinally coupling together said sections, and brackets securable to installed arches for supporting said sections.

20. The arrangement defined in claim 9 wherein said table has a plurality of trough-like sections each having a plurality of extensible legs.

21. The arrangement defined in claim 20 wherein each of said trough-like sections has a pair of roller conveyors engageable with said pallets for supporting same.

22. The arrangement defined in claim 21, further comprising means for displacing said roller conveyors between an upper and a lower position.

23. The arrangement defined in claim 22 wherein said means for displacing said roller conveyors includes pneumatically actuated cylinders.

24. The arrangement defined in claim 9 wherein each of said pallets is formed as a frame having an upper surface of curvature corresponding to that of an arch upper part and provided with holders for an arch upper part and a lower surface formed to fit said head and said table.

25. The arrangement defined in claim 24 wherein said pallets are provided with quick-release catches for securing said pallets to said head.

26. The arrangement defined in claim 9 wherein said means for assembling is a portal-shaped crane having wheels for riding on said rail.

27. The arrangement defined in claim 26 wherein said crane is provided with pneumatic motors connected to said wheels.

28. The arrangement defined in claim 27 wherein said crane has a pneumatically powered hoist.

* * * * *